US005819141A

United States Patent [19]

Facci et al.

[11] Patent Number: 5,819,141

[45] Date of Patent: Oct. 6, 1998

[54] CONTROL OF FLUID CARRIER RESISTANCE AND LIQUID CONCENTRATION IN AN AQUATRON CHARGING DEVICE

[75] Inventors: John S. Facci, Webster; Joseph D. LaRussa, Rochester; Michael J. Levy, Webster, all of N.Y.

[73] Assignee: Xerox Corporation, Stamford, Conn.

[21] Appl. No.: 974,099

[22] Filed: Nov. 19, 1997

[51] Int. Cl.[6] ..... G03G 15/02

[52] U.S. Cl. ..... 399/174; 399/50; 399/168; 361/225; 361/226

[58] Field of Search ..... 399/168, 174, 399/175, 176, 50, 240; 361/225, 226

[56] References Cited

U.S. PATENT DOCUMENTS 5,457,523 10/1995 Facci et al. .
5,510,879 4/1996 Facci et al. .
5,602,626 2/1997 Facci et al. ..... 399/135
5,666,607 9/1997 Camis ..... 399/176
5,777,651 7/1998 Facci et al. ..... 399/168 X
5,781,833 7/1998 Lewis et al. ..... 399/168

*Primary Examiner*—Matthew S. Smith
*Attorney, Agent, or Firm*—Tammy Fair; Annette L. Bade

[57] ABSTRACT

An apparatus and method that utilize a sensor circuit and a liquid supply to control resistance of a fluid carrier of an aquatron. The resistance of the fluid carrier or charging pad is maintained by controlling the loading or concentration of liquid in the charging pad. A comparison of the fluid or liquid level in the charging pad to the desired fluid level for the charging pad triggers the addition or reduction of fluid to the charging pad to achieve the desired fluid level and thus the desired resistance. A minimum fluid carrier resistance is required to prevent loading the power supply when charging over pinholes and scratches in the imaging surface.

17 Claims, 4 Drawing Sheets

CONTROL OF FLUID CARRIER RESISTANCE AND LIQUID CONCENTRATION IN AN AQUATRON CHARGING DEVICE

This invention relates generally to an electrostatographic printer and copier, and more particularly, concerns an apparatus for enabling ion transfer via ionic conduction through an ionically conductive liquid, primarily for use in electrostatographic applications, for example, for charging an imaging member such as a photoreceptor or a dielectric charge receptor.

CROSS-REFERENCE

Cross-reference is made to and priority is claimed from U.S. patent application Ser. No. 08/974,098 entitled "Roll Charger with Semi-Permeable Membrane for Liquid Charging" by Facci et al., U.S. patent application Ser. No. 08/974,097 entitled "Web Liquid Charging: Improved Resistance To Contamination" by Facci et al. and U.S. patent application Ser. No. 08/974,663 entitled "Method for Improving Charging Uniformity of an Aquatron" by Levy et al., each assigned to the same assignee as the present application.

BACKGROUND OF THE INVENTION

The following disclosures may be relevant to various aspects of the present invention and may be briefly summarized as follows:

U.S. Pat. No. 5,602,626 to Facci et al. discloses an apparatus for applying an electrical charge to a charge retentive surface by transporting ions through an ionically conductive liquid and transferring the ions to the member to be charged across the liquid/charge retentive surface interface. The ionically conductive liquid is contacted with the charge retentive surface for depositing ions onto the charge retentive surface via a wetted donor blade supported within a conductive housing, wherein the housing is coupled to an electrical power supply for applying an electrical potential to the ionically conductive liquid. In one specific embodiment, the charging apparatus includes a support blade for urging the donor blade into contact with the charge retentive surface and a wiping blade for wiping any liquid from the surface of the charge retentive surface as may have been transferred to the surface at the donor blade/charge retentive surface interface.

U.S. Pat. No. 5,510,879 to Facci et al. discloses a process for charging layered imaging members by the transfer of ions thereto from an ionically conductive medium.

U.S. Pat. No. 5,457,523 to Facci et al. discloses a device for applying an electrical charge to a charge retentive surface by transporting ions in a fluid media and transferring the ions to the member to be charged across the fluid media/charge retentive surface interface. The fluid media is positioned in contact with a charge retentive surface for depositing ions onto the charge retentive surface. In one specific embodiment, the fluid media is a ferrofluid material wherein a magnet is utilized to control the position of the fluid media, which, in turn, can be utilized to selectively control the activation of the charging process.

SUMMARY OF INVENTION

Briefly stated, and in accordance with one aspect of the present invention, there is provided an apparatus for applying an electrical charge to an imaging surface, comprising: a fluid carrier being in adjacent proximity of the imaging surface to provide a charge thereto; means for supplying fluid to the fluid carrier; and a sensing device to measure an amount of liquid supplied to the liquid carrier.

Pursuant to another aspect of the present invention, there is provided a method for controlling resistance by maintaining a desired moisture level during charging of an imaging surface, comprising: supplying fluid to a fluid carrier in adjacent proximity to the imaging surface for charging; sensing electrically an actual moisture level of fluid in the fluid carrier; and comparing the actual moisture level to the desired theoretical moisture level to determine a need for adjusting the actual moisture level.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 4:
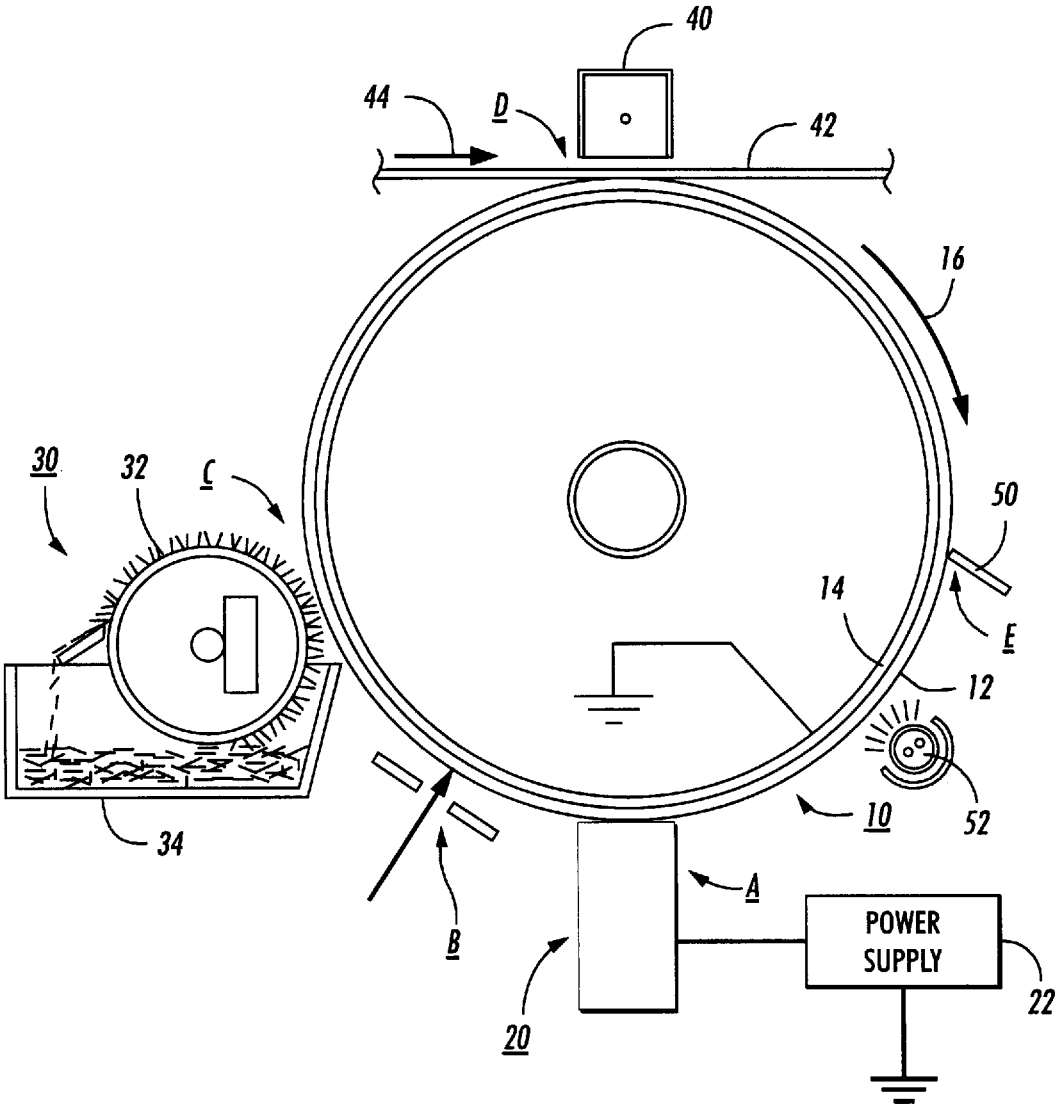
FIG. 4 is a schematic elevational view showing an electrophotographic copier employing the features of the present invention.

For a general understanding of the features of the present invention, reference is made to the drawings wherein like reference numerals have been used throughout to designate identical elements. Referring initially to FIG. 4 prior to describing the invention in detail, a schematic depiction of the various components of an exemplary electrophotographic reproducing apparatus incorporating the fluid media charging structure of the present invention is provided. Although the apparatus of the present invention is particularly well adapted for use in an automatic electrophotographic reproducing machine, it will become apparent from the following discussion that the present fluid media charging structure is equally well suited for use in a wide variety of electrostatographic processing machines and is not necessarily limited in its application to the particular embodiment or embodiments shown herein. In particular, it should be noted that the charging apparatus of the present invention, described hereinafter with reference to an exemplary charging system, may also be used in a transfer, detack, or cleaning subsystem of a typical electrostatographic apparatus since such subsystems also require the use of a charging device.

The exemplary electrophotographic reproducing apparatus of FIG. 4 employs a drum 10 including a photoconductive surface 12 deposited on an electrically grounded conductive substrate 14. A motor (not shown) engages with drum 10 for rotating the drum 10 to advance successive portions of photoconductive surface 12 in the direction of arrow 16 through various processing stations disposed about the path of movement thereof, as will be described.

Initially, a portion of drum 10 passes through charging station A. At charging station A, a charging structure in accordance with the present invention, indicated generally by reference numeral 20, charges the photoconductive surface 12 on drum 10 to a relatively high, substantially uniform potential. This charging device will be described in detail hereinbelow.

Once charged, the photoconductive surface 12 is advanced to imaging station B where an original document (not shown) is exposed to a light source for forming a light image of the original document which is focused onto the charged portion of photoconductive surface 12 to selectively dissipate the charge thereon, thereby recording an electrostatic latent image corresponding to the original document onto drum 10. One skilled in the art will appreciate that a properly modulated scanning beam of energy (e.g., a laser beam) may be used to irradiate the charged portion of the photoconductive surface 12 for recording the latent image thereon.

After the electrostatic latent image is recorded on photoconductive surface 12, drum 10 is advanced to development station C where a magnetic brush development system, indicated generally by the reference numeral 30, deposits developing material onto the electrostatic latent image. The magnetic brush development system 30 includes a single developer roller 32 disposed in developer housing 34. Toner particles are mixed with carrier beads in the developer housing 34, creating an electrostatic charge therebetween which causes the toner particles to cling to the carrier beads and form developing material. The developer roller 32 rotates to form a magnetic brush having carrier beads and toner particles magnetically attached thereto. As the magnetic brush rotates, developing material is brought into contact with the photoconductive surface 12 such that the latent image thereon attracts the toner particles of the developing material, forming a developed toner image on photoconductive surface 12. It will be understood by those of skill in the art that numerous types of development systems could be substituted for the magnetic brush development system shown herein.

After the toner particles have been deposited onto the electrostatic latent image for development thereof, drum 10 advances the developed image to transfer station D, where a sheet of support material 42 is moved into contact with the developed toner image via a sheet feeding apparatus (not shown). The sheet of support material 42 is directed into contact with photoconductive surface 12 of drum 10 in a timed sequence so that the developed image thereon contacts the advancing sheet of support material 42 at transfer station D. A charging device 40 is provided for creating an electrostatic charge on the backside of sheet 42 to aid in inducing the transfer of toner from the developed image on photoconductive surface 12 to a support substrate 42 such as a sheet of paper. While a conventional coronode device is shown as charge generating device 40, it will be understood that the fluid media charging device of the present invention can be substituted for the corona generating device 40 for providing the electrostatic charge which induces toner transfer to the support substrate materials 42. The support material 42 is subsequently transported in the direction of arrow 44 for placement onto a conveyor (not shown) which advances the sheet to a fusing station (not shown) which permanently affixes the transferred image to the support material 42 creating a copy or print for subsequent removal of the finished copy by an operator.

Invariably, after the support material 42 is separated from the photoconductive surface 12 of drum 10, some residual developing material remains adhered to the photoconductive surface 12. Thus, a final processing station, namely cleaning station E, is provided for removing residual toner particles from photoconductive surface 12 subsequent to separation of the support material 42 from drum 10. Cleaning station E can include various mechanisms, such as a simple blade 50, as shown, or a rotatably mounted fibrous brush (not shown) for physical engagement with photoconductive surface 12 to remove toner particles therefrom. Cleaning station E may also include a discharge lamp 52 for flooding the photoconductive surface 12 with light in order to dissipate any residual electrostatic charge remaining thereon in preparation for a subsequent imaging cycle. As will be described, the present invention may also be utilized as a substitute for such a discharge lamp to counter any residual electrostatic charge on the photoconductive surface 12.

The foregoing description should be sufficient for purposes of the present application for patent to illustrate the general operation of an electrophotographic reproducing apparatus incorporating the features of the present invention. As described, an electrophotographic reproducing apparatus may take the form of any of several well known devices or systems. Variations of the specific electrostatographic processing subsystems or processes described herein may be expected without affecting the operation of the present invention.

The resistance of the aquatron fluid carrier (e.g. foam) needs to be maintained within tolerances for proper operation. All contact charging methods including aquatron charging are susceptible to loading of the power supply when charging over photoreceptor defects such as pinholes and scratches. A minimum fluid carrier resistance is required to prevent loading the power supply when charging over pinholes and scratches in the photoreceptor. Loading the power supply results in a voltage drop and an image quality defect such as a deletion or black stripe (depending on the type of development). The upper resistance limit is set by the need to minimize the voltage drop across the fluid carrier itself. A sensor and liquid pumping arrangement successfully controls the moisture level and resistance of the fluid carrier.

It has been found that the resistance of the fluid (or liquid) carrier (e.g. foam) is controlled by the water concentration. Controlling the water concentration controls the contact resistance. Because minimum resistance is required to avoid image quality defects, a maximum water concentration must not be exceeded. It is prudent to work nearer the lower resistance limit rather than the upper resistance limit because it is more difficult to maintain charge uniformity near the upper limit where the fluid carrier may become locally dry.

It is thus proposed that a method of actively controlling the resistance of the aquatron fluid carrier (e.g. foam) by electrically sensing the moisture level or resistance of the carrier. The sensor circuit controls a pump which delivers the required amount of liquid to the fluid carrier to maintain the desired resistance.

A simple and reliable electronic sensor has been fabricated that measures the resistance of the fluid carrier independent of the magnitude of the DC charging bias. Thus, the concentration of fluid (e.g. water) in the carrier (in weight per cent of fluid in the fluid carrier) and its resistance are controllable even while a charging bias is applied to the carrier. Thus fluid concentration can be continuously controlled during an extended copy/print run. Preferably, the concentration of the fluid in the fluid carrier should be from about 50 weight per cent to about 200 weight per cent in order to obtain or achieve a desired resistance for said fluid carrier.

Figure 1:
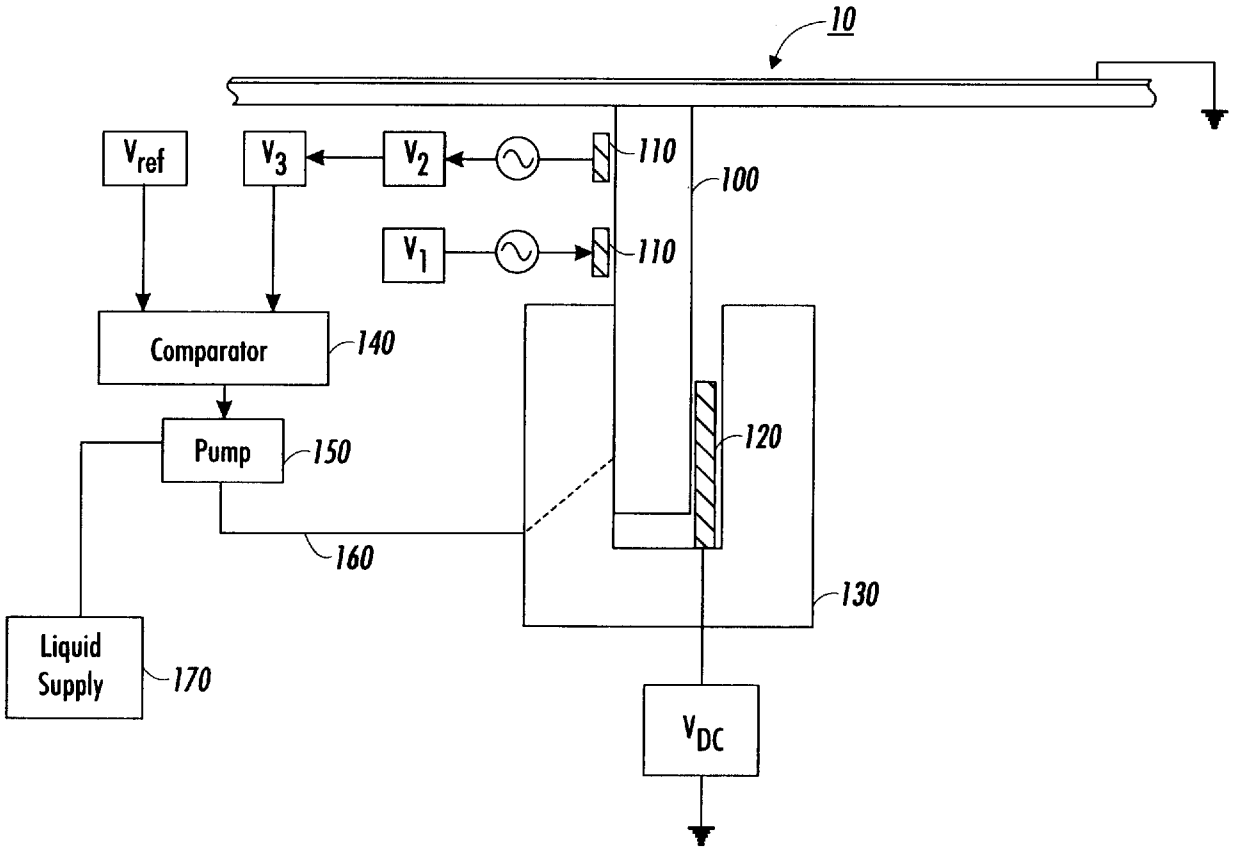
FIG. 1 is a block diagram of the water concentration and resistance control mechanism of an aquatron fluid carrier.

Reference is now made to FIG. 1 which shows a block diagram of an aquatron fluid carrier fitted with a high voltage contact and two sensor contacts 110. The sensor contacts 110 are preferably made from stainless steel. However, the sensor contacts 110 can be fabricated of any electrical conductor including nickel, brass, aluminum, gold, or a composite conductor including a carbon filled polymer or a metal coated fabric including nickel coated weaves. The electrical contact of these sensor contacts 110 can be made an integral part of the carrier, i.e. coated onto the carrier by conventional coating techniques such as electroless deposition, spray, vacuum evaporation and the like. The fluid carrier 100 is fastened into a holder to enable liquid to simultaneously and evenly moisten the entire length of the fluid carrier 100. A conduit 160 supplies liquid from the liquid supply reservoir 170 to the liquid carrier 100 as needed for this purpose. The carrier 130 can be made of an insulator or conductor (an insulator is preferred). If it is conductive the high voltage DC bias can be supplied to the holder directly. It is important to note that at least one of the sensor electrical contacts 110 must be independent of the $V_{DC}$ bias electrode 120. This is so as not to short circuit the sensor and the measurement of fluid carrier resistance. The block diagram in FIG. 1 shows the general principles of the sensor operation.

Figure 2:
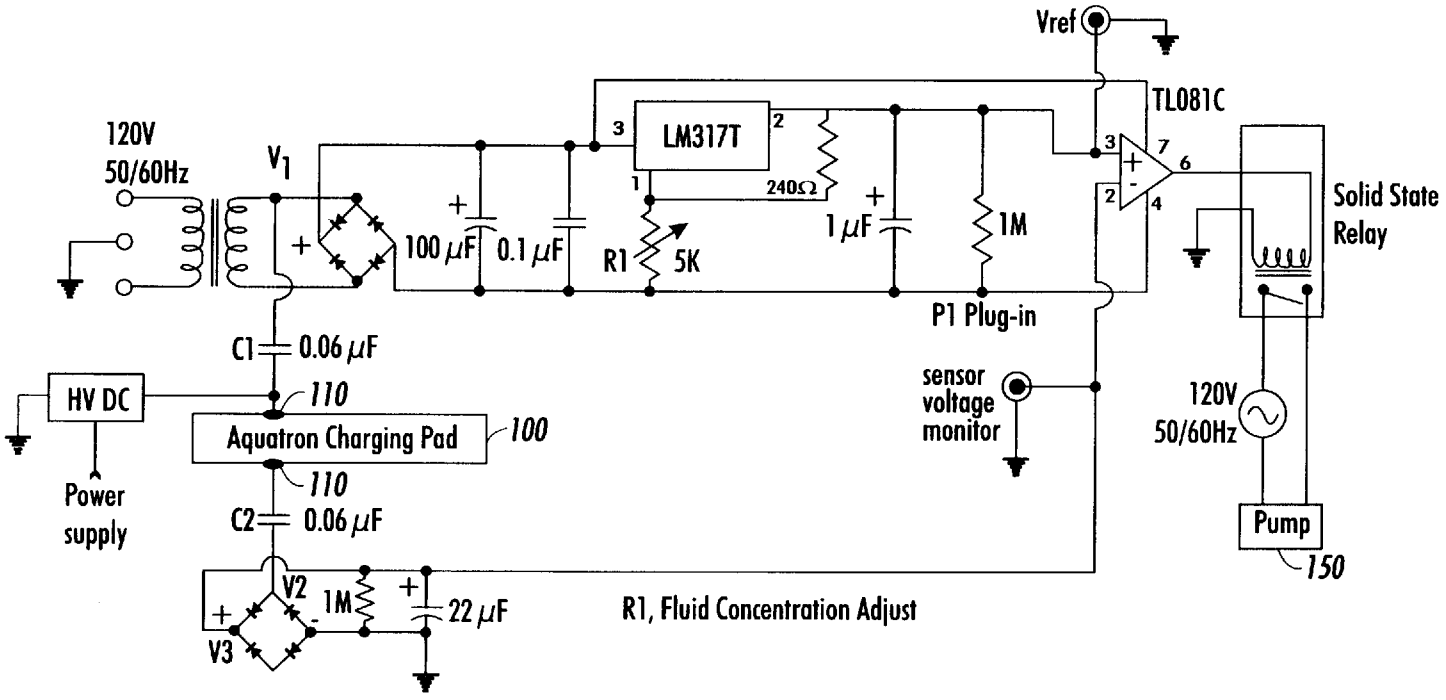
FIG. 2 is a schematic diagram of the sensor circuit that controls the resistance of the aquatron fluid carrier.
Figure 3:
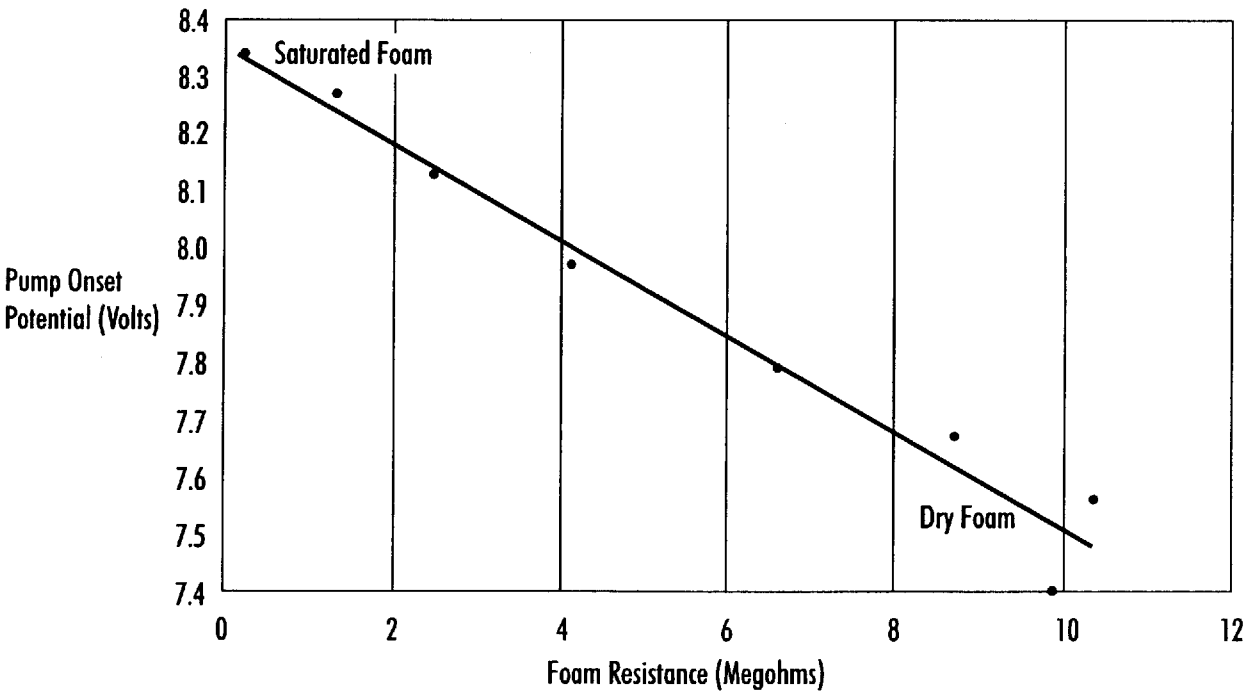
FIG. 3 is a graphical depiction of the relationship between foam resistance and pump onset voltage.

Reference is now made to FIG. 2 which shows a schematic diagram of the sensor circuit of the present invention. The fluid carrier (e.g. foam) resistance measurements are made by applying $V_1$, a low voltage 60 Hz AC signal, to one of the sensor contacts 110. Due to the liquid carrier resistance, the AC voltage $V_2$, at the other sensor electrode, is lower. The voltage $V_2$ is then rectified by a half-wave rectifier and filtered to a DC voltage $V_3$. The voltage $V_3$ is then compared by comparator (TL081C) to a user or machine settable reference voltage $V_{ref}$. When the concentration of liquid (e.g. water) in the fluid carrier decreases the resistance increases and $V_3$ drops below $V_{ref}$. The comparator 140 then turns on a relay which switches on a miniature pump 150. A small inexpensive piston pump 150 suffices to provide the low delivery rates that are required. The delivery rate of the pump 150 should be about equal to the timescale at which water is transported through the fluid carrier 100 in order to minimize overshooting the water concentration (and undershooting the target resistance). When the water concentration and hence, the resistance return to the desired value, $V_3$ increases causing the comparator 140 output to toggle back to its original state, de-energizing the relay, thereby stopping the pump 150.

With continuing reference to FIG. 2, supply capacitors C1 and C2, isolate the DC charging voltage from the CA resistance sensing and control circuit. The reference voltage, $V_{ref}$, is controlled by variable resistor R1 connected to an adjustable voltage regulator, such as terminal 1 on an LM317T. Decreasing the value of R1 decreases $V_{ref}$ which, in turn, gives a drier, more resistive contact. Therefore, a maximum reference voltage establishes an upper limit of fluid concentration while limiting a minimum fluid carrier resistance to prevent loading a high voltage power supply when charging over pinholes and scratches in the imaging surface. Further, a minimum reference voltage establishes a lower limit of fluid concentration while limiting a maximum fluid carrier resistance to efficiently apply a high voltage power supply to the imaging surface.

When the fluid carrier is pressed into contact with a rotating drum photoreceptor under a DC charging bias, the circuit of FIG. 2 successfully holds the fluid carrier at a constant resistance and fluid (e.g. water) concentration. The control circuit controls the fluid carrier resistance indefinitely. In bench testing, the charge uniformity also appears to be excellent. The resistance values are in about the right range for eliminating pinhole/scratch induced image quality defects. Higher resistance values should be obtainable.

One advantage of using the sensing and control circuit is that the aquatron reservoir need not be located near the photoreceptor enabling the footprint of the device on the photoreceptor to be very small. This can be an advantage in an imaging apparatus that uses a small diameter photoreceptor drum or a CRU (Customer Replaceable Unit). In addition, the pump may be eliminated if it is replaced by a solenoid and the liquid is gravity fed to the aquatron.

In recapitulation, the present invention utilizes a sensor circuit and a liquid supply to control resistance of a fluid carrier of an aquatron. The resistance of the fluid carrier or charging pad is maintained by controlling the loading or concentration of liquid in the charging pad. An electrical measurement of the resistance of the charging pad is compared to the desired resistance. When the charging pad becomes too dry, the electronics sense that the resistance is too high and actuates the liquid supplier (e.g. pump) to deliver fluid into the charging pad. As the moisture in the charging pad increases, the resistance lowers to the desired value. At the desired value the electronic circuit signals the liquid supplier (e.g. pump) to turn off. If the actual resistance is less than the desired resistance, the electronics signal the fluid supplier to not dispense fluid.

It is, therefore, apparent that there has been provided in accordance with the present invention, a sensing and control circuit that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. An apparatus for applying an electrical charge to an imaging surface, comprising:

a fluid carrier being in adjacent proximity of the imaging surface to provide a charge thereto;

means for supplying fluid to said fluid carrier; and a sensing device to measure an amount of fluid supplied to said fluid carrier.

2. An apparatus as recited in claim 1, wherein said fluid carrier comprises a charging pad.

3. An apparatus as recited in claim 1, wherein said sensing device comprises a fluid concentration sensor having a sensor circuit that controls said supply means to provide the appropriate amount of fluid to said fluid carrier to maintain a desired resistance.

4. An apparatus as recited in claim 3, wherein said fluid concentration sensor determines weight per cent of fluid in said fluid carrier.

5. An apparatus as recited in claim 4, wherein a preferable range for the weight per cent of the fluid comprises about 50 weight percent to about 200 weight per cent to achieve a desired resistance for said fluid carrier.

6. An apparatus as recited in claim 3, wherein the sensor circuit electrically senses a fluid concentration of said fluid carrier.

7. An apparatus as recited in claim 6, wherein the fluid concentration electrically sensed provides an actual resistance that is compared to a desired resistance.

8. An apparatus as recited in claim 7, wherein when the actual resistance is less than the desired resistance fluid dispensation from the supplying means is stopped.

9. An apparatus as recited in claim 7, wherein the actual resistance being greater than the desired resistance a continuation of fluid dispensation is maintained from said supply means, decreasing resistance until the desired resistance has been reached.

10. An apparatus as recited in claim 7, wherein a minimum fluid carrier resistance is required to prevent loading a high voltage power supply when charging over pinholes and scratches in the imaging surface.

11. An apparatus as recited in claim 1, wherein said supplying means comprises a pump for dispensing fluid from a fluid reservoir to said fluid carrier.

12. An apparatus as recited in claim 1, wherein said supplying means comprises an electrically actuated valve for actuating a gravity fed delivery of the fluid from a fluid reservoir to said fluid carrier.

13. An apparatus as recited in claim 1, wherein a maximum reference voltage establishes an upper limit of fluid concentration while limiting a minimum fluid carrier resistance to prevent loading a high voltage power supply when charging over pinholes and scratches in the imaging surface.

14. An apparatus as recited in claim 1, wherein a minimum reference voltage establishes a lower limit of fluid concentration while limiting a maximum fluid carrier resistance to efficiently apply a high voltage power supply to the imaging surface.

15. A method for controlling resistance by maintaining a desired fluid concentration during charging of an imaging surface, comprising:

supplying fluid to a fluid carrier in adjacent proximity to the imaging surface for charging;

sensing electrically an actual fluid concentration of fluid in the fluid carrier; and comparing the actual fluid concentration to a desired theoretical fluid concentration to determine a need for adjusting the actual fluid concentration.

16. A method as recited in claim 15, wherein the step of comparing comprises:

determining the actual fluid concentration is greater than the desired theoretical fluid concentration; and stopping a supply of fluid to the fluid carrier.

17. A method as recited in claim 15, wherein the step of comparing comprises:

determining the actual fluid concentration is less than the desired fluid concentration; and continuing a supply of fluid to the fluid carrier.

* * * * *